US005479947A

United States Patent [19]

Dyett

[11] Patent Number: 5,479,947

[45] Date of Patent: Jan. 2, 1996

[54] CIGARETTE MAKING MACHINE

[75] Inventor: Derek H. Dyett, High Wycombe, England

[73] Assignee: Molins PLC, Milton Keynes, England

[21] Appl. No.: 260,475

[22] Filed: Jun. 14, 1994

[30] Foreign Application Priority Data

Jun. 19, 1993 [GB] United Kingdom ..... 9312704

[51] Int. Cl.[6] ..... A24C 5/24

[52] U.S. Cl. ..... 131/37; 131/69

[58] Field of Search ..... 131/35, 285, 37, 131/69, 90; 118/216, 219, 241, 255, 256

[56] References Cited

U.S. PATENT DOCUMENTS 1,838,112 12/1931 Rundell ..... 131/69 X

FOREIGN PATENT DOCUMENTS 2814733 10/1978 Germany ..... 131/37
6133754 5/1994 Japan ..... 131/37
1541002 2/1979 United Kingdom .

*Primary Examiner*—Jennifer Bahr
*Attorney, Agent, or Firm*—Antonelli, Terry, Stout & Kraus

[57] ABSTRACT

A device for applying adhesive to the wrapper in a cigarette making machine (particularly upstream of the garniture) includes a conveyor for conveying the wrapper web (18) along a path between two guides (24, 26), a pair of nozzles (28, 30) each of which is movable into and away from contact with the wrapper web, and a device (36) for controlling the positions of the nozzles so that one nozzle at a time is brought into contact with the wrapper web and that the inoperative nozzle lies in a retracted position at which a brush (32) is provided for automatically removing the adhesive string from it, the arrangement being such that movement of the thus-cleaned nozzle towards the wrapper web is continued so as to displace the wrapper web from the previously active nozzle, which is then retracted for cleaning, whereupon the newly active nozzle is slightly retracted to assume its normal operating position adjacent to the wrapper web at which it will apply adhesive until the other nozzle, in a similar manner, displaces the web from it to allow a similar cleaning operation.

5 Claims, 1 Drawing Sheet

CIGARETTE MAKING MACHINE

In a cigarette making machine the paper web forming the cigarette wrapper is commonly sealed by means of adhesive applied to one edge of the wrapper in the region of the garniture by which the web is wrapped around the tobacco stream forming the cigarette filler. A common problem in such machines is that excess adhesive from the nozzle tends to form a growing solidified string hanging from the nozzle and this has to be removed periodically by the operator as it otherwise tends to wipe off the adhesive which is intended to remain on the edge of the wrapper web. Removal of this string while the machine is in operation requires great care in order not to break the wrapper web.

With increasing machine speeds, it has become desirable to automate the delivery of materials to the maker, including the wrapper web, and this automation coupled with increasing speeds reduces the practicability of relying on the operator to remove the adhesive string from the nozzle. The present invention is concerned with an arrangement whereby the string is removed automatically and, in the preferred construction, involves the application of adhesive to the wrapper upstream of the garniture, which itself has other potential advantages.

According to the present invention, a device for applying adhesive to the wrapper web in a cigarette making machine (particularly upstream of the garniture) comprises a pair of movable nozzles, means for controlling the position of each nozzle so that one nozzle at a time is in position to apply adhesive to the wrapper web while the other nozzle is in a retracted position, and cleaning means for removing the accumulated adhesive string from each nozzle while in the retracted position.

A preferred device according to this invention comprises means for conveying the wrapper web along a path between two guides, a pair of nozzles each of which is movable into and away from contact with the wrapper web, and means for controlling the positions of the nozzles so that one nozzle at a time is brought into contact with the wrapper web and that the inoperative nozzle lies in a retracted position at which means are provided for automatically removing the adhesive string from it, the arrangement being such that movement of the thus-cleaned nozzle towards the wrapper web is continued so as to displace the wrapper web from the previously active nozzle, which is then retracted for cleaning, whereupon the newly active nozzle is slightly retracted to assume its normal operating position adjacent to the wrapper web at which it will apply adhesive until the other nozzle, in a similar manner, displaces the web from it to allow a similar cleaning operation.

Control of the positions of the nozzles can be achieved in any convenient manner, for example by means of cam or solenoid devices. The means for cleaning the nozzles may comprise a wire brush or two brushes cooperating with the respective nozzles.

An example of a device according to this invention is shown in the accompanying drawings. In these drawings.

Figure 1:
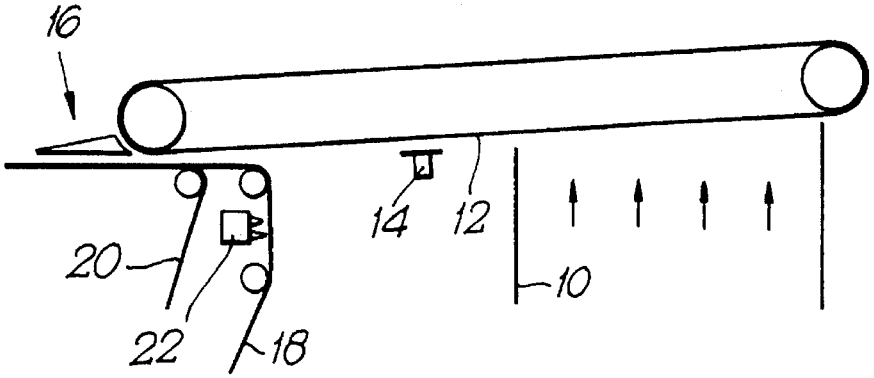
FIG. 1 is a diagrammatic illustration of a cigarette making machine including the device for applying adhesive.

FIG. 1 illustrates a conventional cigarette making machine in which tobacco is showered pneumatically up a chimney 10 to form a tobacco filler stream on the underneath surface of a suction tape 12. After trimming by means of a trimming device 14, the filler stream is delivered into a garniture 16 in which a paper wrapper web 18 is wrapped around the filler stream. The web 18 is carried through the garniture by a garniture tape 20. Adhesive is applied to one edge of the wrapper web, before it reaches the garniture, by means of a device 22 including two nozzles which are shown on a larger scale in FIGS. 2 and 3.

Figure 2:
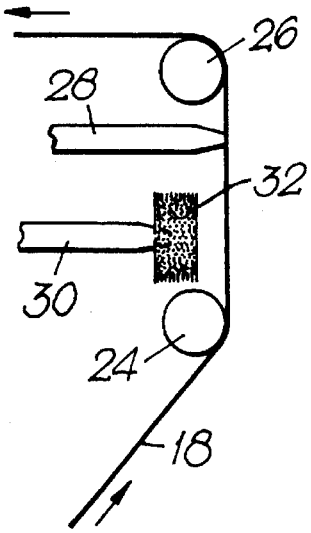
FIG. 2 is an enlarged view of the adhesive-applying device in one mode of operation.

As shown in FIG. 2, the wrapper web 18 passes around two guide rollers 24 and 26 and during normal operation the web moves along a substantially straight path between those rollers, though it may be slightly deflected by the operative nozzle which at this stage is the nozzle 28. FIG. 2 shows the nozzle 28 in contact with the web, while the second nozzle 30 is in a retracted position in which it is being cleaned by a rotary wire brush 32.

Figure 3:
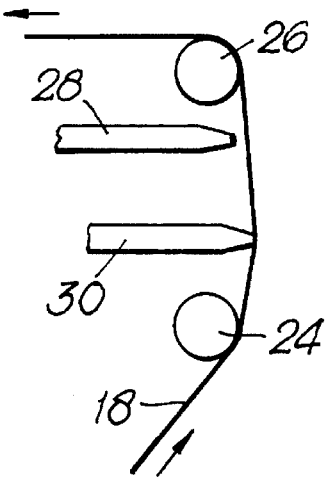
FIG. 3 is a similar enlarged view of the adhesive-applying device in another mode of operation.

After an appropriate period of time during which the nozzle 28 remains operative, the nozzle 30 is advanced briefly to the position shown in FIG. 3 in which it displaces the web from the nozzle 28, which is then retracted and cleaned by a wire brush similar to the brush 32 (or by a common brush dealing with both nozzles). Immediately after the nozzle 28 has been retracted to the cleaning position, the nozzle 30 is retracted slightly so as to allow the web to assume its normal substantially straight run between the rollers 24 and 26.

A similar cycle occurs after the nozzle 30 has been in operation for a period of time after which it needs cleaning. Namely, the nozzle 28 is advanced so as to displace the web from the nozzle 30, which is then retracted for cleaning, and the nozzle 28 is then retracted slightly to the position shown in FIG. 2.

Figure 4:
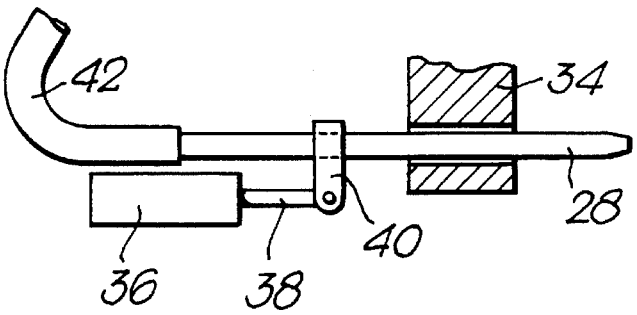
FIG. 4 illustrates diagrammatically a means for controlling the position of one of the nozzles.

FIG. 4 shows diagrammatically the way one of the nozzles 28 is mounted for axial movement and is controlled as to its position as described above. The nozzle is slidable axially in a bore in a fixed guide member 34, its position being controlled by a solenoid device 36 including a slidably movable rod 38 connected to a collar 40 on the nozzle. Adhesive is supplied to the nozzle from a control valve (not shown) via a flexible pipe 42.

Finally, it should be understood that the supply of adhesive to each nozzle continues only while the nozzle is in contact with the web. While each nozzle is in its retracted position for cleaning, a suitable form of control valve (not shown) shuts off the supply of adhesive to it.

I claim:

1. A device for applying adhesive to the wrapper web in a cigarette making machine comprising a pair of movable nozzles, means for controlling the position of each nozzle so that one nozzle at a time is in position to apply adhesive to the wrapper web while the other nozzle is in a retracted position, and cleaning means for removing the accumulated adhesive string from each nozzle while in the retracted position.

2. A device according to claim 1 in which the means for removing the adhesive strings comprises a brush or pair of brushes.

3. A device according to claim 1 or claim 2, in which the nozzle movement control is such that each nozzle, on moving to its operative position adjacent to the wrapper web, at first moves forward so as to displace the wrapper web away from the other nozzle and then moves backwards to its operative position, by which time the other nozzle is arranged to be retracted for cleaning.

4. A device for applying adhesive to the wrapper in a cigarette making machine comprising means for conveying the wrapper web along a path between two guides, a pair of nozzles each of which is movable into and away from contact with the wrapper web, and means for controlling the positions of the nozzles so that one nozzle at a time is brought into contact with the wrapper web and that the inoperative nozzle lies in a retracted position at which means are provided for automatically removing the adhesive string from it, the arrangement being such that movement of the thus-cleaned nozzle towards the wrapper web is continued so as to displace the wrapper web from the previously active nozzle, which is then retracted for cleaning, whereupon the newly active nozzle is slightly retracted to assume its normal operating position adjacent to the wrapper web at which it will apply adhesive until the other nozzle, in a similar manner, displaces the web from it to allow a similar cleaning operation.

5. A method of making cigarettes in which adhesive is applied to the wrapper web by conveying the wrapper web past a pair of nozzles each of which is movable into and away from contact with the wrapper web, with means for controlling the positions of the nozzles so that one nozzle at a time is brought into contact with the wrapper web and that the inoperative nozzle lies in a retracted position at which means are provided for automatically removing the adhesive string from it, the arrangement being such that movement of the thus-cleaned nozzle towards the wrapper web is continued so as to displace the wrapper web from the previously active nozzle, which is then retracted for cleaning, whereupon the newly active nozzle is slightly retracted to assume its normal operating position adjacent to the wrapper web at which it will apply adhesive until the other nozzle, in a similar manner, displaces the web from it to allow a similar cleaning operation.

* * * * *